US010069184B2

(12) United States Patent
Uher et al.

(10) Patent No.: US 10,069,184 B2
(45) Date of Patent: Sep. 4, 2018

(54) COMPACT AND LIGHTWEIGHT TEM-LINE NETWORK FOR RF COMPONENTS OF ANTENNA SYSTEMS

(71) Applicant: MacDonald, Dettwiler and Associates Corporation, Ste-Anne-de-Bellevue (CA)

(72) Inventors: Jaroslaw Uher, Ile Bizard (CA); Stéphane Lamoureux, Mirabel (CA); Sylvain Richard, Kirkland (CA)

(73) Assignee: MacDonald, Dettwiler and Associates Corporation, Ste-Anne-de-Bellevue, QC (CA)

( * ) Notice: Subject to any disclaimer, the term of this patent is extended or adjusted under 35 U.S.C. 154(b) by 0 days.

(21) Appl. No.: 15/418,154

(22) Filed: Jan. 27, 2017

(65) Prior Publication Data

US 2017/0222295 A1 Aug. 3, 2017

Related U.S. Application Data

(60) Provisional application No. 62/288,283, filed on Jan. 28, 2016.

(51) Int. Cl.

| | |
|---|---|
| ***H01P 5/12*** | (2006.01) |
| ***H01P 5/19*** | (2006.01) |
| ***H01P 1/202*** | (2006.01) |
| ***H01P 3/02*** | (2006.01) |
| ***H01P 3/06*** | (2006.01) |

(52) U.S. Cl.

CPC ..... *H01P 5/19* (2013.01); *H01P 1/202* (2013.01); *H01P 3/02* (2013.01); *H01P 3/06* (2013.01)

(58) Field of Classification Search

CPC .... H01P 5/19; H01P 1/202; H01P 3/02; H01P 3/06

See application file for complete search history.

(56) References Cited

U.S. PATENT DOCUMENTS

2012/0133457 A1* 5/2012 Nita ..... H01P 1/202 333/206

OTHER PUBLICATIONS

I. Llamas-Garro et al; "A low loss wideband suspended transmission line", Microwave and Optical Technology Letters, Oct. 20, 2004 (Oct. 20, 2004) , pp. 93-95.*

* cited by examiner

*Primary Examiner* — Robert J Pascal
*Assistant Examiner* — Kimberly Glenn
(74) *Attorney, Agent, or Firm* — Praxis

(57) ABSTRACT

A TEM-line network architecture for RF components used in antenna system, includes an electrically conductive main body forming an outer conductor defining a signal channel, and an electrically conductive center conductor electrically grounded to the main body at predetermined locations. The center conductor is electromagnetically isolated from the outer conductor at RF frequencies while being connected and supported within the signal channel only at at least one of the predetermined locations. The outer conductor is preferably formed of three layers with the center conductor being integral with one of the layers.

11 Claims, 3 Drawing Sheets

COMPACT AND LIGHTWEIGHT TEM-LINE NETWORK FOR RF COMPONENTS OF ANTENNA SYSTEMS

CROSS REFERENCE TO RELATED APPLICATION

This application claims priority of U.S. Provisional Application for Patent No. 62/288,283 filed Jan. 28, 2016, the content of which is incorporated herein by reference in its entirety.

FIELD OF THE INVENTION

The present invention relates to the field of antenna systems, and is more particularly concerned with a compact and lightweight TEM-line (Transverse Electromagnetic) network for RF (Radio-Frequency) components of antenna systems, such as dual-band antenna feed systems.

BACKGROUND OF THE INVENTION

It is well known in the art of transmission lines for electromagnetic signals in antennas to use feed systems implementing Orthogonal Mode Junction (OMJ) with waveguide networks for both Tx (transmit) and Rx (receive) signal paths. Such implementation, especially for on-board spacecraft applications, typically fulfils operation requirements such as:

- combined Tx and Rx functionality;
- dual circular or linear polarization functionality;
- high Tx-Rx signal isolation;
- low signal insertion loss;
- excellent signal XPD (Cross Polar Discrimination) and axial ratio performance;
- good thermal dissipation capability; and
- low PIM (Passive Inter-Modulation) products.

These requirements are also typically tied with the smallest possible overall volume and the lowest possible mass of the antenna feed systems.

However, the typical relatively large overall volume and mass achieved with such antenna feed systems implementations, including an OMJ with waveguide network for both Tx and Rx signals paths, preclude their use in many applications, where the volume and the mass should still be reduced by at least a factor of two (2).

Although other designs such as TEM-line networks, utilizing a simple coupler 100 shown in FIGS. 1-4, including an electrically conductive center or inner conductor 102 (with a branch-line coupler centrally located 103) supported by dielectric supports 104 inside a channeled electrically conductive outer conductor, typically made out of a channeled base part 106 and a generally flat top cover part 108, are typically smaller and lighter, they have the drawbacks of not being capable of achieving other requirements. Effectively, the electrically isolating dielectric supports of the center conductor limit the signal power handling because of heat generation due to signal losses within the supports that need to be dissipated (in vacuum environment for space applications). This in turn generally increases the overall insertion loss of the antenna system, and therefore decreases the performance of the antenna.

Accordingly, there is a need for an improved compact and lightweight TEM-line network for antenna system, and associated dual-band antenna feed system.

SUMMARY OF THE INVENTION

It is therefore a general object of the present invention to provide an improved compact and lightweight TEM-line network for antenna system, and associated dual-band antenna feed system, that solve the above-mentioned drawbacks.

An advantage of the present invention is that the TEM-line network architecture includes a center or inner conductor that is supported only at electrical grounding locations, i.e. without the use of any dielectric supports.

A further advantage of the present invention is that the TEM-line network architecture is capable of low PIM products, especially because of the electrical connection between the inner conductor and the outer conductor or chassis.

Another advantage of the present invention is that the TEM-line network architecture is amenable to manufacturing with excellent assembly precision.

A further advantage of the present invention is that the TEM-line network architecture is capable of high thermal dissipation, especially because of a good thermal conduction path between the inner conductor and the outer conductor or chassis, and because of the absence of dielectric supports.

Still another advantage of the present invention is that the TEM-line network architecture is relatively immune to ESD (Electrostatic Discharge), again because of the electrical connection between the inner conductor and the outer conductor or chassis, and because of the absence of dielectric supports.

Yet another advantage of the present invention is that the TEM-line network architecture has a good structural strength, again because of a structural link between the inner conductor and the outer conductor or chassis.

Still a further advantage of the present invention is that a dual-band antenna feed system associated with the above TEM-line network meets all the above requirements with at least the factor of 2 in mass reduction (relative to existing antenna feed systems implementations), for combined first and second signals (such as Tx and Rx signals) functionality with sufficiently low PIM products. An example of such a dual-band antenna feed system combines, for the first signal (such as the relatively higher power Tx signal) path, the above TEM-line network (square /rectangular coaxial line) with four (4) orthogonally positioned coaxial probes (fundamental mode launchers in circular or square waveguides) and coaxial stub filters rejecting the second signal (such as the frequencies of the relatively low power Rx signal), two (2) ratrace couplers and a branch-line coupler to generate circular polarization, and three (3) pairs of shorted stubs which have a threefold functionality, structural, thermal and RF. For the second signal, the dual-band antenna feed system could include a circular or square waveguides feed network with septum polarizers or alternatively an OMJ based network.

According to an aspect of the present invention there is provided a TEM-line network architecture for RF (Radio-Frequency) components used in antenna system, said TEM-line network architecture comprising:

- an electrically conductive main body forming an outer conductor, said outer conductor defining a signal channel having a cross-section, said signal channel defining a signal path having a signal propagation axis generally centrally located within said cross-section; and
- an electrically conductive center conductor being electrically grounded to the main body at predetermined locations, said center conductor generally extending along the signal propagation axis of the signal channel, while being electromagnetically isolated from the outer conductor at RF frequencies, said center conductor being supported within said signal channel only at at least one of said predetermined locations, and without using dielectric support.

In one embodiment, the center conductor is integral with at least a portion of the main body so that the use of dielectric supports is not required.

In one embodiment, the center conductor includes a signal section extending along the signal propagation axis and a stub section extending from the signal section in a direction generally perpendicular to the signal propagation axis to the outer conductor at said predetermined locations.

Conveniently, the stub section includes a plurality of pairs of stubs.

In one embodiment, the outer conductor includes three layers extending on top of one another.

Conveniently, the three layers include a top layer, a bottom layer and an intermediate layer located in-between the top and bottom layers, the top, intermediate and bottom layers each having a portion of the signal channel formed therein.

Conveniently, the intermediate layer includes the central conductor located within the portion of the signal channel formed therein.

Conveniently, the central conductor is integral with the outer conductor of the intermediate layer.

According to another aspect of the present invention there is provided a dual-band antenna feed system architecture for transmitting a first signal and receiving a second signal at first and second frequency bands, respectively, said dual-band antenna feed system architecture comprising:

a first signal path including a plurality of, typically four (4) orthogonally positioned, coaxial probes, each having a respective coaxial stub filter rejecting the second signal, and a TEM-line network including at least one component architecture, said at least one component architecture including:

an electrically conductive main body forming an outer conductor, said outer conductor defining a signal channel having a cross-section, said signal channel defining a signal path having a signal propagation axis generally centrally located within said cross-section; and an electrically conductive center conductor being electrically grounded to the main body at predetermined locations, said center conductor generally extending along the signal propagation axis of the signal channel, while being electromagnetically isolated from the outer conductor at RF frequencies, said center conductor being supported within said signal channel only at at least one of said predetermined locations; and a second signal path including a waveguide network having at least one signal polarizer, combined with a signal combiner and/or coupler for generating dual polarization of the second signal.

In one embodiment, the first signal path includes ratrace couplers connected to an orthomode junction including the plurality of coaxial probes and a branch-line coupler, each one of the ratrace couplers, the orthomode junction and the branch-line coupler being a component architecture of the TEM-line network.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

Figure 2:
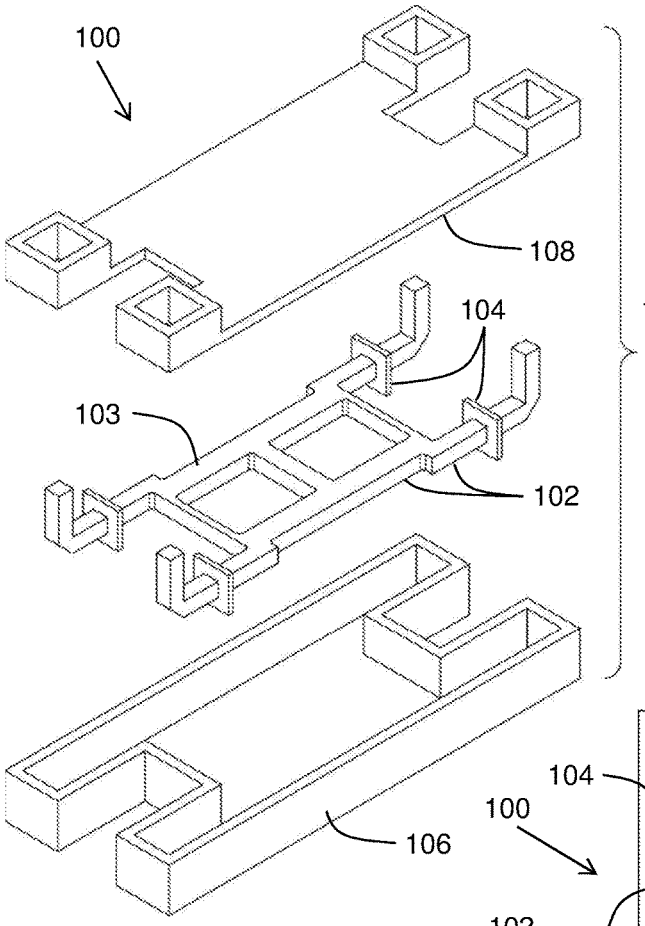
Fig.2 (Prior Art)
FIG. 2 is an exploded top perspective view of the TEM-line coupler of FIG. 1.
Figure 4:
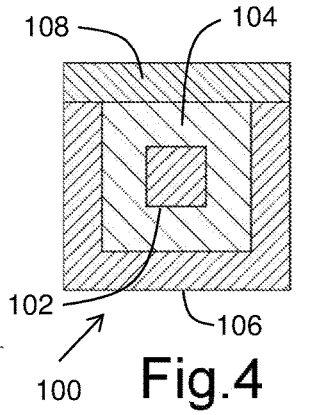
Fig.4 (Prior Art)
FIG. 4 is an enlarged section view taken along line 4-4 of FIG. 3, and including the top layer.
Figure 1:
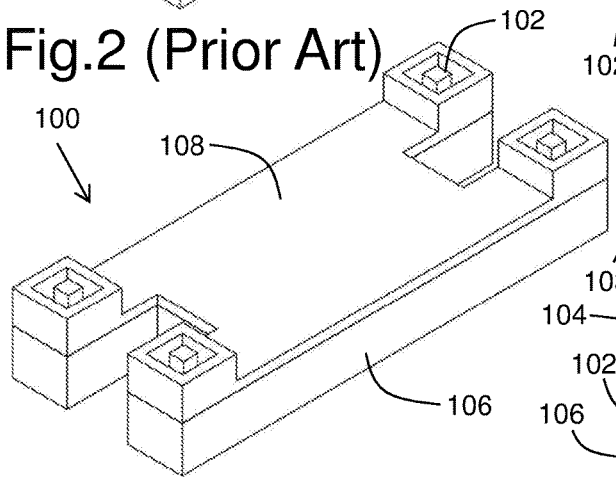
Fig.1 (Prior Art)
FIG. 1 is a top perspective view of a TEM-line coupler network architecture of the prior art.
Figure 3:
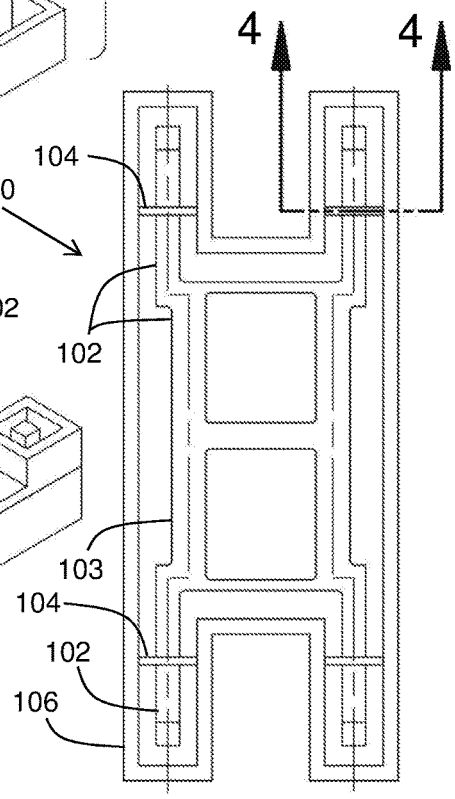
Fig.3 (Prior Art)
FIG. 3 is a top plan view of the TEM-line coupler of FIG. 1 with the top cover removed.
Figure 6:
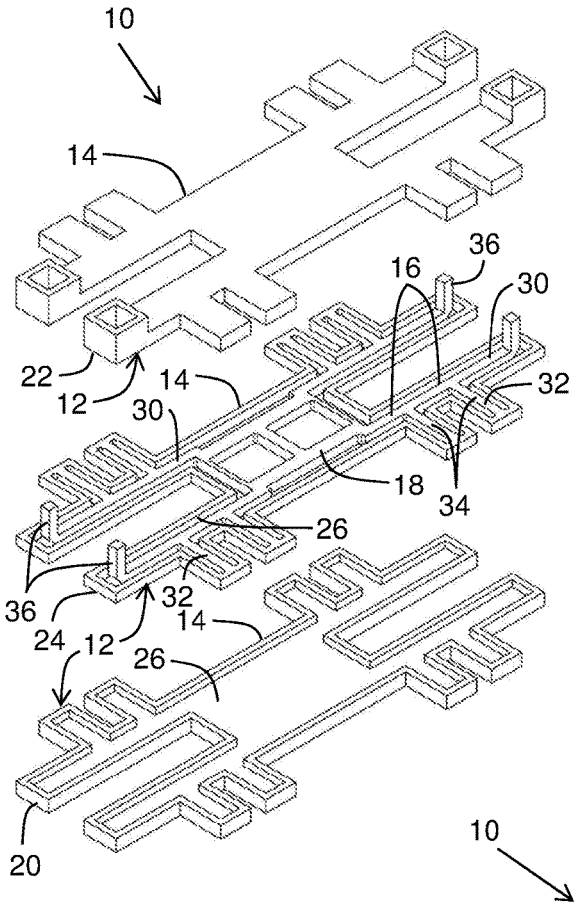
FIG. 6 is an exploded top perspective view of the embodiment of FIG. 5.

With reference to the annexed drawings the preferred embodiment of the present invention will be herein described for indicative purpose and by no means as of limitation.

Referring to FIGS. 5 through 8, there is shown a TEM-line (Transverse Electromagnetic line) network architecture 10 in accordance with an embodiment of the present invention, such as a TEM-line coupler, for antenna systems, and associated dual-band antenna feed systems, especially with relatively high power signals (such as a relatively high power Tx signal relative to a relatively low power Rx signal).

The TEM-line coupler 10 typically includes a main body 12 defining an outer conductor 14 forming a generally closed (in cross-section) channeled path having an inner or center conductor 16 typically electromagnetically isolated therefrom at RF (Radio-Frequency) frequencies but electrically DC (Direct Current) connected (grounded) thereto at predetermined locations, and running into and along the channeled path and supporting antenna electromagnetic signals running there along. The outer conductor 14 is typically formed out of three layers, namely a bottom layer 20, a top layer 22, and an intermediate layer 24 located in-between. The center conductor 16 is supported within the channeled path only at at least one, and typically all of the predetermined locations, with no dielectric supports at all. In the embodiment 10 shown, the center conductor 16 includes a 3-branch coupler 18 generally centrally located.

Figure 8:
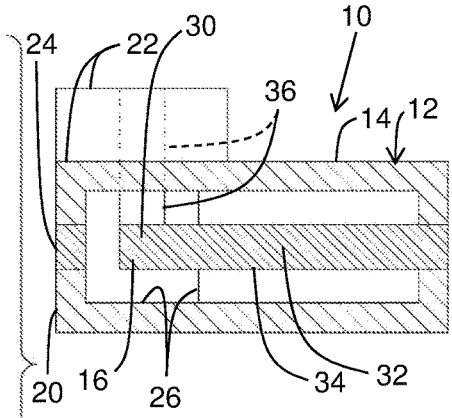
FIG. 8 is an enlarged section view taken along line 8-8 of FIG. 7, and including the top layer.
Figure 5:
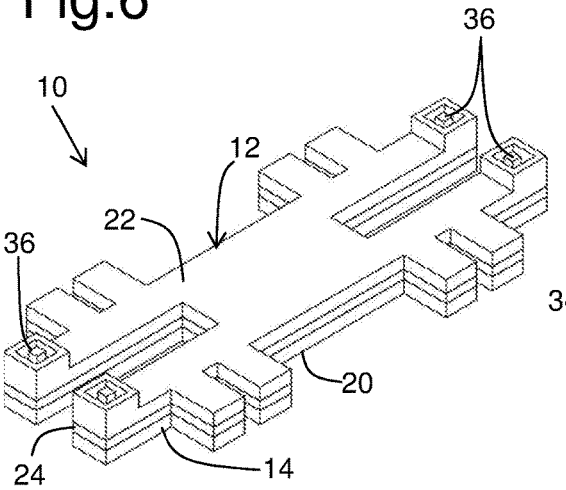
FIG. 5 is a top perspective view of a TEM-line coupler network architecture in accordance with an embodiment of the present invention.
Figure 7:
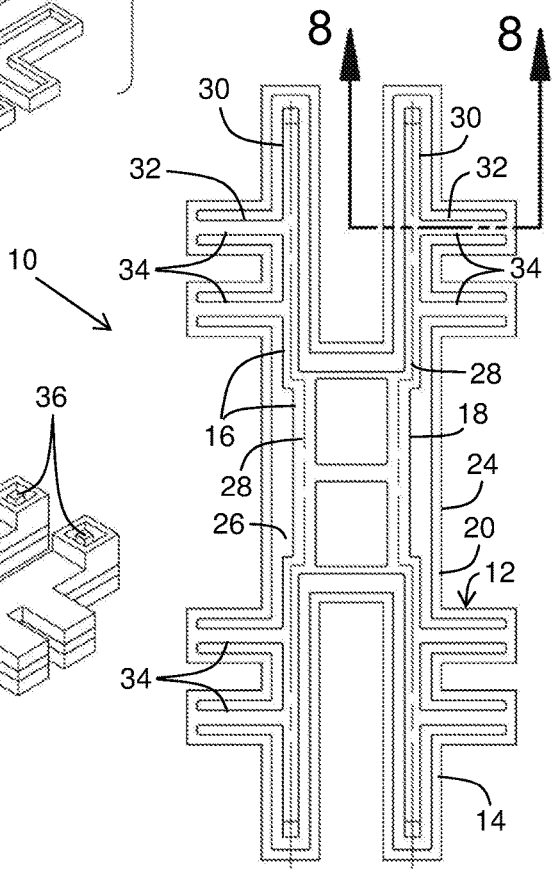
FIG. 7 is a top plan view of the embodiment of FIG. 5 with the top layer removed.

At least the inner surface 26 of the channel path is electrically conductive, with the channel having a closed typically substantially rectangular cross-section, as better seen in FIG. 8 (the shape of the cross-section could be different without departing from the scope of the present invention, as being square, circular, and the like). The signal channel path defines a signal propagation axis 28 generally centrally located within the cross-section. The electrically conductive center conductor 16 generally extends along the signal propagation axis 28 of the signal channel, and is electrically connected or grounded to the main body 12 at the predetermined locations. Typically, the center conductor 16 is integral with at least a portion of the main body 12 (or formed in the same piece), such as the intermediate layer 24 of the outer conductor 14.

Typically, the center conductor 16 includes a signal section 30 extending along the signal propagation axis 28 and a stub section 32 extending from the signal section 30 in a direction generally perpendicular to the signal propagation axis 28 to the outer conductor 14 at the predetermined locations.

Typically, the stub section 32 includes a plurality of pairs of stubs 34, with each stub 34 extending from the signal section 30 of the center conductor 16 to the outer conductor 14 where it is grounded thereto and forms one of the predetermined locations. Each pair of stubs 34 allowing the grounding of the center conductor 16 to the outer conductor 14 while allowing the signal isolation between the center 16 and outer 14 conductors, without inducing significant signal losses.

The portions of the channel path formed into the top 22 and bottom 20 layers of the main body 12 are essentially a mirror image of each other, except at the location of each input and output ports 36 of the center conductor 16 where the center conductor 16 at least partially extends through one of the top 22 and bottom 20 layers.

Although not illustrated, one skilled in the art would readily realize that, without departing from the scope of the present invention, the three layers can be secured to one another in different ways while ensuring a good electrical path there between.

Figure 9:
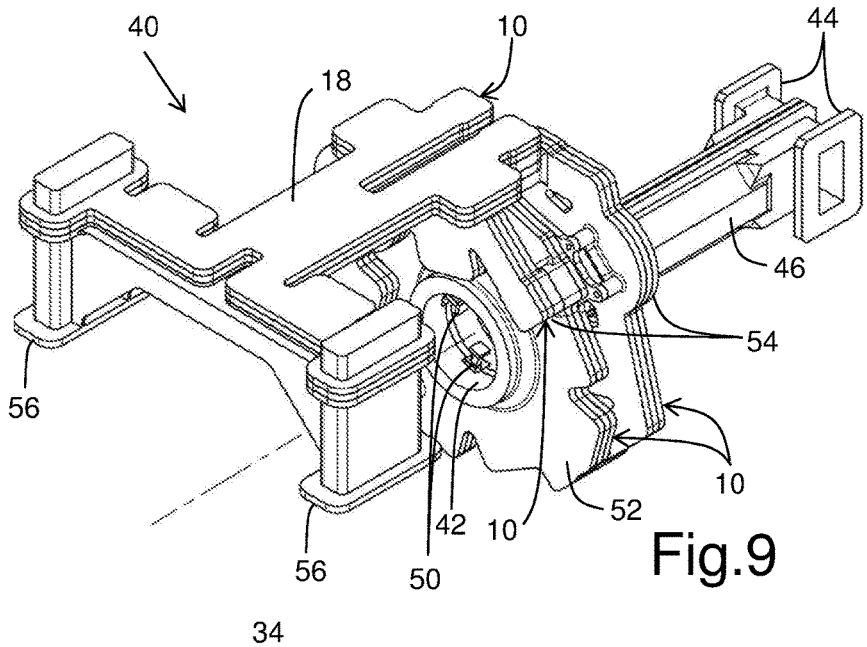
FIG. 9 is a top perspective view of a TEM-line portion of a dual-band antenna feed system architecture in accordance with an embodiment of the present invention.
Figure 10:
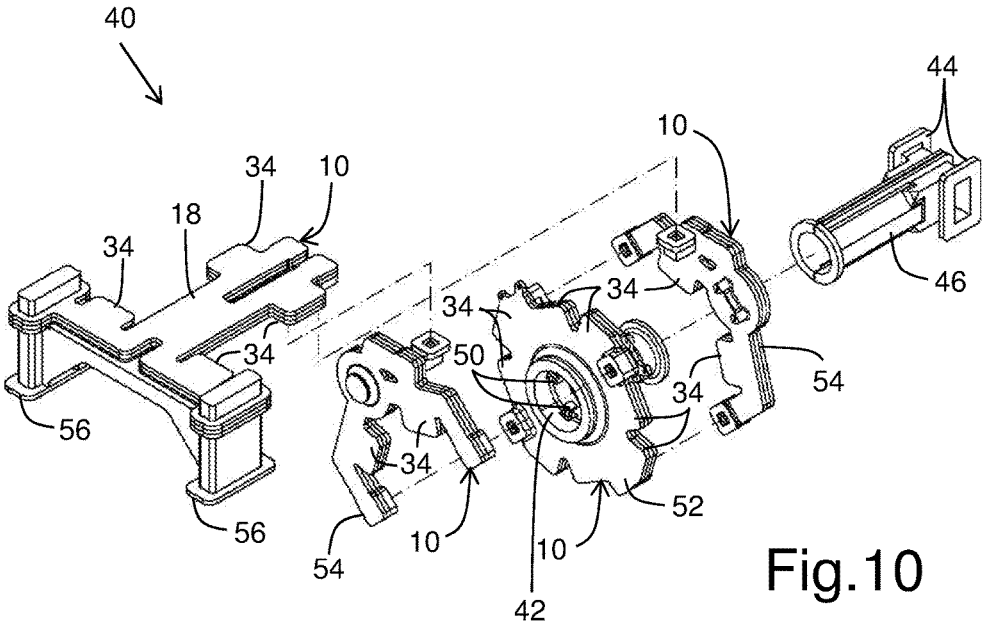
FIG. 10 is an enlarged top perspective view taken along line 8-8 of FIG. 7, and including the top layer.

Referring to FIGS. 9 and 10, there is shown a TEM-line network or portion of a dual-band antenna feed system 40 architecture in accordance with an embodiment of the present invention. The dual-band antenna feed system 40 operates with first and second signals having their respective frequency band, such as Tx and Rx signals. In the embodiment 40 shown in FIGS. 9 and 10, the feed system has a waveguide central common Tx/Rx port 42 connectable to a feed horn (not shown).

The dual-band antenna feed system 40 typically includes two (2) different network architectures for both the first (Tx) end second (Rx) signal paths. The Rx signal path is typically realized in waveguide technology capable of generating dual polarization signals, as dual LP (linear polarization) or dual CP (circular polarization) signals, such that it could include a circular or square waveguides feed network with septum polarizers or alternatively an OMJ based network with RF signal combiners and a coupler, or a combination of a corrugated polarizer and an OMT (Orthogonal Mode Transducer). In FIGS. 9 and 10, the Rx signal coming from the feed horn runs through the central common port 42 to axially propagate to the output ports 44 of the Rx CP signals of the waveguide septum polarizer 46.

The Tx signal path typically includes a plurality of, preferably four (4) orthogonally positioned, output TEM-line probes 50 (fundamental mode launchers in circular or square waveguides) of the orthomode junction 52 with their respective coaxial stub filters rejecting the second Rx signal and TEM-line stub filters, with the above TEM-line network 10 (square/rectangular coaxial line) that includes two (2) ratrace couplers 54 connected to the orthomode junction 52 and a branch-line coupler 18 to generate circular polarization from the Tx signal entering at the input ports 56, and four (4) pairs of shorted stubs 34 which have an important threefold functionality, especially for a high power signal: structural, thermal and RF. The component architectures of the TEM-line network, including the orthomode junction 52, the ratrace couplers 54 and the branch-line coupler 18 all have pairs of shorted stubs 34, typically adjacent respective signal ports.

Although not illustrated, one skilled in the art would readily realize that, without departing from the scope of the present invention, the architecture of the dual band antenna feed system 40 could vary depending on the specific details and requirements of the antenna. For examples, fewer than four (4) probes could be considered, or a different TEM-line path geometry combined with different RF components, or a TEM-line network with a circular cross-section (or combination of square, rectangular and/or circular) of the channel path.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinabove described and/or hereinafter claimed.

We claim:

1. A dual-band antenna feed system architecture for transmitting a first signal and receiving a second signal at first and second frequency bands, respectively, said dual-band antenna feed system architecture comprising:

a first signal path including a plurality of coaxial probes, each having a respective coaxial stub filter rejecting the second signal, and a TEM-line network including at least one component architecture, said at least one component architecture including:

an electrically conductive main body forming an outer conductor, said outer conductor defining a signal channel having a cross-section, said signal channel defining a signal path having a signal propagation axis generally centrally located within said cross-section; and an electrically conductive center conductor being electrically grounded to the main body at predetermined locations, said center conductor generally extending along the signal propagation axis of the signal channel, while being electromagnetically isolated from the outer conductor at RF frequencies, said center conductor being supported within said signal channel only at at least one of said predetermined locations; and a second signal path including a waveguide network having at least one signal polarizer, combined with a signal combiner and/or coupler for generating dual polarization of the second signal.

2. The dual-band antenna feed system architecture of claim 1, wherein the first signal path includes ratrace couplers connected to an orthomode junction including the plurality of coaxial probes and a branch-line coupler, each one of the ratrace couplers, the orthomode junction and the branch-line coupler being a component architecture of the TEM-line network.

3. The dual-band antenna feed system architecture of claim 1, wherein the center conductor is integral with at least a portion of the main body.

4. The dual-band antenna feed system architecture of claim 1, wherein the center conductor includes a signal section extending along the signal propagation axis and a stub section extending from the signal section in a direction generally perpendicular to the signal propagation axis to the outer conductor.

5. The dual-band antenna feed system architecture of claim 4, wherein the stub section includes a plurality of pairs of stubs.

6. The dual-band antenna feed system architecture of claim 1, wherein the outer conductor includes three layers extending on top of one another.

7. The dual-band antenna feed system architecture of claim 6, wherein the three layers include a top layer, a bottom layer and an intermediate layer located in-between the top and bottom layers, the top, intermediate and bottom layers each having a portion of the signal channel formed therein.

8. The dual-band antenna feed system architecture of claim 7, wherein the intermediate layer includes the central conductor located within the portion of the signal channel formed therein.

9. The dual-band antenna feed system architecture of claim 8, wherein the central conductor is integral with the outer conductor of the intermediate layer.

10. The dual-band antenna feed system architecture of claim 9, wherein the center conductor includes a signal section extending along the signal propagation axis and a stub section extending form the signal section in a direction generally perpendicularly to the signal propagation axis to the outer conductor at said predetermined locations.

11. The dual-band antenna feed system architecture of claim 10, wherein the stub section includes a plurality of pairs of stubs.

* * * * *